United States Patent [19]

Bartholomew

[11] Patent Number: 4,991,293

[45] Date of Patent: Feb. 12, 1991

[54] MEANS FOR PROVIDING VERY SMALL BEND RADII IN THE TUBE-LIKE STRUCTURES

[75] Inventor: Donald D. Bartholomew, Marine City, Mich.

[73] Assignee: Proprietary Technology, Inc., Southfield, Mich.

[21] Appl. No.: 388,508

[22] Filed: Aug. 2, 1989

[51] Int. Cl.[5] ..... B21D 7/00

[52] U.S. Cl. ..... 29/890.149; 72/369

[58] Field of Search ..... 72/369; 29/157 A; 285/179, 183; 138/121

[56] References Cited

U.S. PATENT DOCUMENTS

| | | | |
|---|---|---|---|
| 2,995,151 | 8/1961 | Lockwood | 138/121 |
| 3,247,581 | 4/1966 | Pellizzari | 29/157 A |
| 3,259,149 | 7/1966 | Curtis et al. | 285/183 |
| 4,464,923 | 8/1984 | Boggs et al. | 29/157 A |

*Primary Examiner*—Lowell A. Larson

*Attorney, Agent, or Firm*—Harness, Dickey & Pierce

[57] ABSTRACT

The method disclosed allows the bending of tubular structures with much smaller radius bends than is normally acceptable for the diameter of the tubing section that is being bent. The method is very useful for making various fittings which perform bent routing functions in piping systems. The method also allows more controllable stretching of the tube metal, because stretching is done prior to bending of the angle.

5 Claims, 1 Drawing Sheet

MEANS FOR PROVIDING VERY SMALL BEND RADII IN THE TUBE-LIKE STRUCTURES

BACKGROUND AND SUMMARY OF THE INVENTION

Making various angle fittings or bending tubes has been a practice for many years. In some applications, long sweeping bends are used where the lowest possible pressure drop in the bend is desired. In other applications the space available, or the necessity to lie close to a right angle corner prompts the manufacturers to reduce the bend radius of the tube.

The use of castings, and the like, has become commonplace. This is because the stretching required to bend most tubing or piping around the outside of the bend, or the compression that is required of the pipe wall material in the inside radius of the bend limits the radius of the bend to some multiple of the tube diameter. In many important cases a large savings in cost would be possible if it were possible to approximate the small bend radius of a casting or machined port fitting with a tubular fitting.

An example of this situation is the use of large numbers of what are called "Banjo" fittings. A "Banjo" fitting has a body which looks a little like a Banjo, in that a stem, to which tubing is attached, extends from a circular end with a hole in the flat circular face of the circular end. This emulates the fret and string arm of a banjo extending from a circular sound box. Banjo fittings also require a bolt, through its center, through a hole in the circular end, to attach the "Banjo" fitting to the port. The fluid passage way is provided by drilling out the arm, and drilling out the center of the bolt. A hole is cross-drilled through the shank of the bolt to allow the fluid to enter the drilled out portion of the centerline of the bolt. Sealing, usually accomplished by a washer shaped gasket, is required between the banjo body and the port and the bolt head. The high cost of a "Banjo" connector is justified by the extensive work and material required to manufacture one. The use of "Banjo connections" has been worldwide for so many years and is eloquent testimony to the benefits which are gained by being able to make very small radius bends which are afforded by a "Banjo" connection.

A "straight-out" connection, and a bend in the pipe or tubing being connected is much less expensive, and much more reliable. If it were not for the routing advantage of a "Banjo" type connection, it is doubtful that any "Banjos" would be used at all.

The means disclosed herein provide a method of achieving the "Banjo" routing advantage, without having to also pay the high cost of a Banjo connection.

It is the object of this invention to provide a tube-like structure which achieves a very small bend radius.

Another object is to provide a complete family of fittings.

Heretofore difficult to obtain advantageous benefits may be more easily and inexpensively gained.

A more clear understanding of the means herein disclosed may be had by referring to the figures and discussion of the figures.

DETAILED DESCRIPTION OF THE PREFERRED EMBODIMENT

Figure 1:
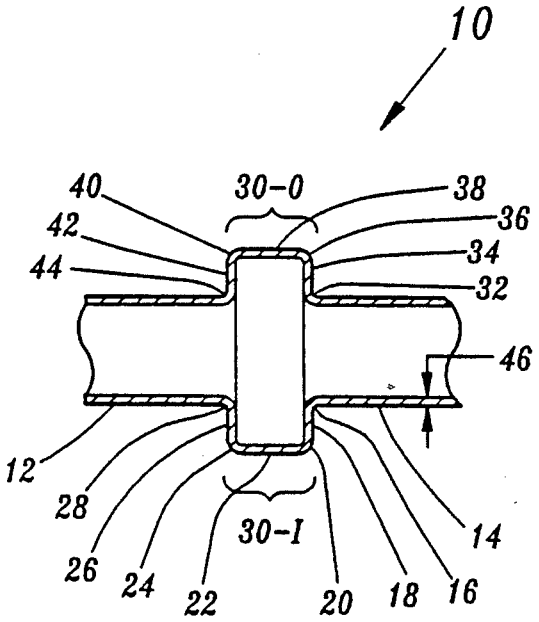
FIG. 1 is a cross-section view of a tube-like structure in accordance with the present invention.

Referring to FIG. 1, a tubular portion 10 is prepared for bending by the method herein disclosed. A portion 30-O (outside radius) and 30-I (inside bend radius) is shown with numbers 16 through 44 assigned to various walls and radii of the bulged section of the tube between tube segments 12 and 14 as will be explained herein.

The walls 18, 22, 26, 34, 38 and 42 are shown substantially flat and planar so as to make radii 16, 20, 24, 28, 32, 36, 40 and 44 more plainly visible. It is noted that it is not necessary that walls 18, 22, 26, 34, 38, and 42 be flat and planar, only that radii 16, 20, 24, 28, 32, 36, and 40 be well enough defined to cause the bending accommodations shown in FIG. 2 to take place as shown in FIG. 2.

Forming this bulged bead-like structure will be accompanied by thinning of the wall 46, due to stretching of the material in the bulged area. It is also noted that there will be "work hardening" of this bent and thinned material if the material is metal. There is, therefore, a benefit to annealing this material before the bending in FIG. 2. If the material is thermoplastic then the deformed material should be heated after the bending of FIG. 2 to "set" the plastic in the bent configuration.

Figure 2:
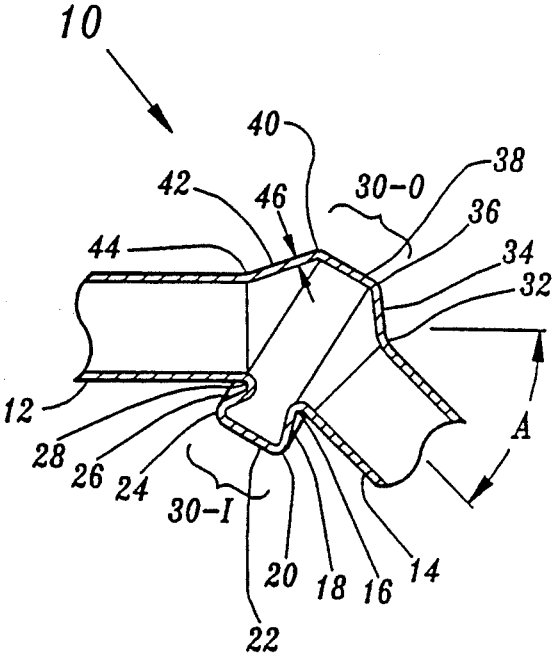
FIG. 2 is a cross-section view like that of FIG. 1 in a bending condition.

Referring to FIG. 2, the surfaces (walls and radii) of the bulged portion are described using the numbers of FIG. 1. These numbers are not shown on FIG. 2 in order that the maximum clarity of the description of the movements of these surfaces be gained.

FIG. 2 shows tube portions 12 and 14 after bending in the amount of angle "A" and the accommodations in the bulged area that have accommodated this angle of bend. The inner radius area of the portion 30-I folds together by bending to a more acute angle radii 16, 20, 24, and 28. Some bending of wall portions 18, 22, and 26 will also occur. The outer radius of the bend 30-0 shows radii 32, 36, 40, and 44 getting larger as walls 34, 38, and 42 come to their new orientation. In between these extremes intermediate bending of the bulged portion occurs.

When this bending to angle "A" takes place a metal material will again work harden, helping to "set" the bend.

Note that the minimum dimensions of the lengths of wall segments 18-34, 20-38, and 26-42 depend on the angle "A" to which the tubes 12 and 14 are bent. In production it is convenient to assume that the maximum angle "A" will be around 110 degrees and made a bulged area that will accommodate that and all smaller angles. One might logically ask why would 110 degrees rather than 90 degrees be chosen? This is because in certain configurations of FIG. 3, one can put a slight bend into the tube leading to one of the terminal ends of device 100 in order that the tube will lay near the surface to which the other end of device 110 is attached. The "Banjo" replacement application is one of these configurations.

Figure 3:
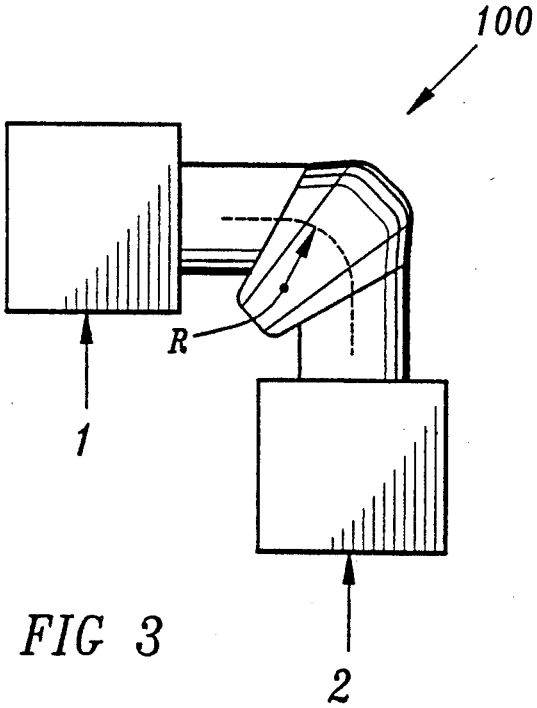
FIG. 3 is a side elevation view of a tube-like structure which is bent, and is terminated by means of attachment to tubing, pipe, hose, or a port of some type.

Referring to FIG. 3, a device 100 is shown that is terminated by ends 1 and 2. The small radius "R" is also shown.

Terminations 1 and 2 may be tubes, swivel nuts, or any ends that facilitate the piping system and connection of that piping system. Radius "R" will depend on materials, diameters, wall thicknesses, the bulged area, or any other factor. Use of the means herein disclosed only permits a smaller radius "R" than other methods, given similar conditions. The method, however, offers the extremely attractive economic prospect of being able to replace many cast and machined fittings with less expensive fittings that offer very beneficial functional capabilities that were in many cases not economically possible with the older technology.

Figure 4:
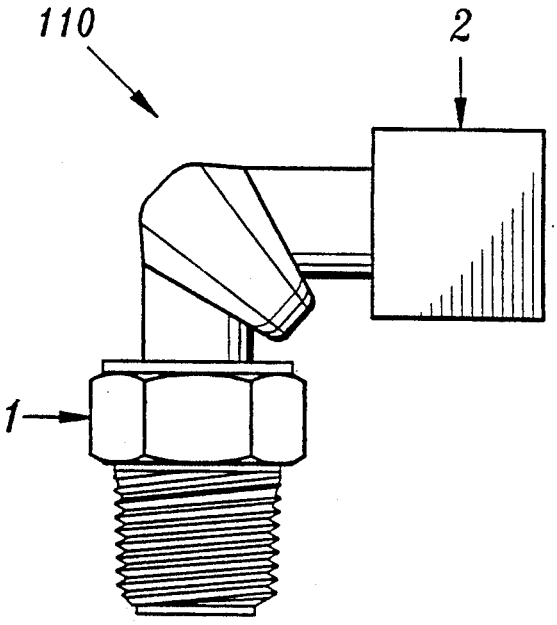
FIG. 4 is a side elevation view like that of FIG. 3 with a device for threading into a port.

FIG. 4 shows one of the above replacements, where one end of the fitting of FIG. 3 has been finished as a replacement for a "Banjo" connector. One immediate benefit is that even after end 1 of device 110 has been threaded into the port, the end 2 is 360 degree swivelable, about the axis of the port, and the nut is sealed to the tubing portion. In the case of a "Banjo" connector, when the bolt is tightened, the "Banjo" shaped portion is no longer swivelable. If the exit direction of the "Banjo" arm is not exactly in the direction required of the exiting piping, this pipe must be bent (if that is possible) or the "Banjo" must be loosened and repositioned.

Combining the "Banjo" treatment of 1 in FIG. 3 with some sort of swiveling quick connector for the 2 arm of device 110 now allows swiveling about two axis. If this quick connector further allows some "wobbling" (of the incoming tube about the quick connector axis), then it is not necessary to have any strain on the incoming piping that results from trying to connect an incoming pipe that is not perfectly formed for a perfect fit.

Since many, many factors can cause a non-perfectly formed pipe or tube, a perfectly fitting pipe is an unusual and rare commodity. The normal variations (even when both ends of the pipe do not move relative to each other during operation) is to use a length of flexible hose or tubing to accommodate non-perfect variations that are inevitably encountered. Obviously if it is not necessary to use this flexible section, the pipe costs much less, and lasts much longer.

There are many benefits that may be gained by employing the means herein disclosed. Because fittings that allow for lower cost and the ability to achieve very small bend radii are not currently available, and because fittings that are available are difficult to have accommodate some of the superior connecting capabilities that are becoming available, individuals, whose business it is to route and attach the multitude of pipes and tubes that are necessary to the functioning of many everyday devices, are rethinking old strategies that they were forced to use in the past when these very accommodating solutions were not available.

The means disclosed may also be used near the end of a thin wall pipe or tube where it is possible to prestretch this type of form. The form is not a simple bead in dimension, and a bead is much harder to subsequently bend. Also a simple bead on a pipe does not allow the large angle bend with no stretching of the pipe wall material during the bending operation. When this form is annealed after the preform stretching, the pipe may be bent to fit at assembly. For this reason, the combination of preforming and annealing is an important benefit that can be obtained with the means herein disclosed. In this latter case, ends 1 and 2 of 100 in FIG. 3 are continuing pieces of the pipe or tube.

From the foregoing, it is clear that there are many functional and economic benefits which may be derived from the relatively simple expedient of forming a relatively large bulge on a tubular pipe or conduit. For a given bend, a forming mandrel may be positioned far enough into the bulged area to round slightly the outer radius of the bend (30-O, in FIG. 2), a slight stretching of that material may be cosmetically beneficial. It is noted that since the entire bend area has been preexpanded prior to bending, there is no constriction of flow area compared to the flow area of the tube portions (see 12 and 14 of FIG. 2) as a result of the bend.

While the above description constitutes the preferred embodiment of the invention, it will be appreciated that the invention is susceptible to modification, variation, and change without departing from the proper scope or fair meaning of the accompanying claims.

I claim:

1. A method of manufacturing a tube-like structure comprising: forming an outwardly bulged annular portion in a tube having ends on both sides of said outwardly bulged annular portion, said ends having a diameter less than said outwardly bulged annular portion, bending said tube at said bulged annular portions, forming a bent configuration tube such that said annular portion has a portion substantially on an outer arc with said tube ends and a portion extending outwardly from an inner arc of said tube ends so that the radius of said bend is less than a radius which would be obtained from forming and bending a continuous diameter tube.

2. As in claim 1 where the length of material in said bulged area is sufficient to allow said bend to be made without stretching the material of said tube-like structure more than the localized stretching of the material comprising a portion of the inside material of radii which are part of said first forming.

3. As in claim 1 where only one outwardly bulged portion is used per bend.

4. As in claim 1 where said bulged area is annealed prior to bending.

5. As in claim 1 where said bent configuration is terminated by means of connecting said configuration to a piping system.

* * * * *

UNITED STATES PATENT AND TRADEMARK OFFICE

CERTIFICATE OF CORRECTION

PATENT NO. : 4,991,293

DATED : Feb. 12, 1991

INVENTOR(S) : Donald D. Bartholomew

It is certified that error appears in the above-identified patent and that said Letters Patent is hereby corrected as shown below:

ON THE TITLE PAGE: in the title - delete "THE";

Col. 1, Line 2, delete "THE";

Col. 2, Line 46, "30-0" should be --30-O--;

Col. 2, Line 59, "made" should be --make--;

Col. 3, Line 29, "2 arm" should be --arm 2--.

Signed and Sealed this

Twenty-second Day of June, 1993

*Attest:*

Michael K. Kirk

MICHAEL K. KIRK

*Attesting Officer*

*Acting Commissioner of Patents and Trademarks*